United States Patent [19]

McNeill et al.

[11] 4,041,352

[45] Aug. 9, 1977

[54] AUTOMATIC STARTING SYSTEM FOR SOLID STATE POWERED ELECTRODELESS LAMPS

[75] Inventors: William H. McNeill, Carlisle; Paul O. Haugsjaa, Acton; Joseph Lech, Westford; Robert J. Regan, Needham, all of Mass.

[73] Assignee: GTE Laboratories Incorporated, Waltham, Mass.

[21] Appl. No.: 705,323

[22] Filed: July 14, 1976

[51] Int. Cl.[2] ..... H05B 41/16; H05B 41/24

[52] U.S. Cl. ..... 315/248; 250/372; 250/504; 315/39; 315/149; 315/158; 315/159; 315/267; 315/344

[58] Field of Search ..... 315/248, 39, 151, 158, 315/159, 151, 104, 267, 283, DIG. 7, 344, 149; 250/504, 372, 373

[56] References Cited

U.S. PATENT DOCUMENTS

| | | | |
|---|---|---|---|
| 3,142,758 | 7/1964 | Dietz | 250/272 |
| 3,196,312 | 7/1965 | Marrison | 315/248 X |
| 3,227,923 | 1/1966 | Marrison | 315/248 |
| 3,258,758 | 6/1966 | Byrd | 250/373 X |
| 3,786,308 | 1/1974 | Browner et al. | 315/248 |
| 3,873,884 | 3/1975 | Gabriel | 315/267 |
| 3,989,983 | 11/1976 | Uchino et al. | 315/248 |
| 4,010,400 | 3/1977 | Hollister | 315/248 |

*Primary Examiner*—Saxfield Chatmon, Jr.
*Attorney, Agent, or Firm*—Irving M. Kriegsman; Leslie J. Hart

[57] ABSTRACT

A starting assist control circuit for an electrodeless light source in which a UV source for assisting in starting an electrodeless lamp is coupled in series with the dc supply for a microwave power source for the lamp so that a reduced dc voltage is supplied to the microwave power source at lamp starting. At staring, a capacitive impedance element is coupled across the inner and outer conductors of the fixture to provide an additional starting assist by creating a condition of resonance in the fixture. A heat responsive bimetallic switch element associated with both the capacitor and the UV source automatically shorts out the UV source and decouples the capacitor after the lamp has started thereby permitting full dc power to the microwave power source during the operating condition of the lamp.

5 Claims, 1 Drawing Figure

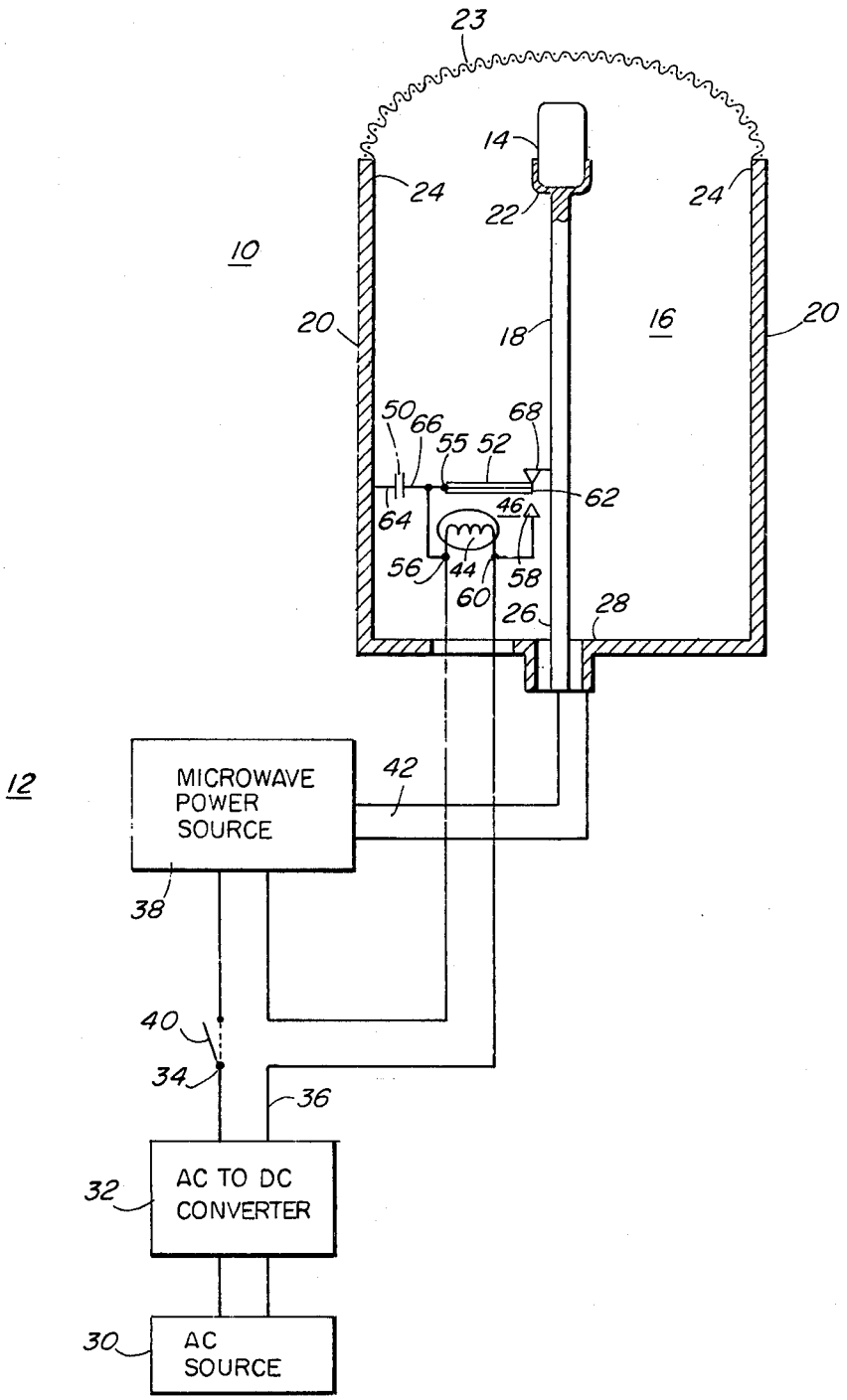
23
14
24
22
24
10
20
18
16
20
50
66
55
52
68
62
64
46
56
44
58
60
26
28
12
MICROWAVE POWER SOURCE
42
38
40
34
36
32
AC TO DC CONVERTER
30
AC SOURCE

AUTOMATIC STARTING SYSTEM FOR SOLID STATE POWERED ELECTRODELESS LAMPS

CROSS-REFERENCE TO RELATED APPLICATIONS

A concurrently filed application entitled "Solid State Microwave Power Source For Use In An Electrodeless Light Source" bears Ser. No. 705,324, is assigned to the same assignee herein, and is filed in the name of Robert J. Regan, Paul O. Haugsjaa and William H. McNeill. Also, a concurrently filed application entitled "Continuous Automatic Starting Assist Circuit For A Microwave Powered Electrodeless Lamp" bears Ser. No. 705,328, is assigned to the same assignee herein, and is filed in the name of Robert J. Regan, Paul O. Haugsjaa and William H. McNeill.

BACKGROUND OF THE INVENTION

The present invention relates to microwave excited electrodeless light sources and, more specifically, to an automatic starting control circuit for an electrodeless lamp powered by a solid state microwave source.

There has recently been developed a light source in which an electrodeless lamp is disposed at the ends of inner and outer conductors of a fixture in which the lamp forms a termination load for microwave power supplied at the other end of the conductors. There have also been developed various types of starting assist devices for this type of light source. The need for a starting assist is due to the high impedance mismatch between the lamp in the off state and the output impedance of the power source which results in a low percentage of the forward directed power being absorbed by the lamp. In one starting scheme, the fixture is made to be in a condition of resonance at starting to increase the power absorbed by the lamp. In another scheme, a UV light source is used to supply a flux of UV photons to the lamp. Both schemes have functioned satisfactorily in providing a starting assist. In both starting assist devices, the operator must manually disconnect the devices after the lamp is started. There exists a need for automatic connecting and decoupling of these devices if the electrodeless light source is to have enhanced versatility. It has also been found that a solid state microwave power source can not tolerate running into large impedance mismatches such as occur when the source is coupled to a lamp in the off state.

SUMMARY OF THE INVENTION

It is an object of the invention to provide a reliable starting control circuit for a microwave powered electrodeless lamp in which a starting assist device is automatically coupled into and decoupled out of the light source while also automatically protecting the power source from damage due to large impedance mismatches.

According to the invention, there is provided a control circuit for use in an electrodeless light source having a source of power at a microwave frequency, an electrodeless lamp having an envelope made of a light-transmitting material and a volatile fill material emitting light upon breakdown and excitation and a termination fixture having an inner conductor and an outer conductor disposed around the inner conductor, the conductors having first ends associated with the lamp and second ends coupled to the source so that microwave power terminates at the lamp to cause breakdown and excitation of the fill material. Accordingly, the source includes a dc power source and a microwave power source receiving the dc power for providing microwave power in an amount related to the amount of dc power received by the dc power source, the output of the microwave power source being coupled to the inner and outer conductors. A switch device is provided for controlling the application of dc power to the microwave power source. A UV producing light source is disposed near the lamp and coupled in series between the the dc power source and the microwave power source to emit UV light upon activation of the switch device to assist in starting the lamp. The UV source upon emission of light decreases the amount of dc power coupled to the microwave power source to reduce the output as the lamp is started. A device responsive to a preselected amount of heat from the UV source provides a shunt path for the dc power to bypass the UV source and thereby to provide maximum dc power to the microwave power source. In another aspect, a capacitive impedance device is adapted to be coupled across the conductors at the second end of the fixture to create a resonant condition in the fixture as microwave power is first applied to the lamp. The heat responsive device decouples the capacitive impedance means after the lamp is started. Preferably, the heat responsive device includes a switch having a bimetallic element electrically coupled at a first end to a first side of the UV source, and a first contact electrically coupled to a second side of the UV source. A second end of the bimetallic element moves into contact with the first contact in response to heat to form a shunt path for the dc current through the bimetallic element around the UV source.

BRIEF DESCRIPTION OF THE DRAWING

In the drawing:

The sole FIGURE is a diagram illustrating the principle components according to the present invention.

DESCRIPTION OF PREFERRED EMBODIMENT

In an exemplary embodiment of the present invention, as shown in the FIGURE, there is provided an electrodeless light source represented generally by the reference numeral 10. The source 10 has a source of power represented generally by the reference numeral 12 at a microwave frequency. As used herein, the term "microwave frequency" is intended to include frequencies within the range of 10 MHz to 300 GHz. An electrodeless lamp 14 is provided and has an envelope made of a light-transmitting material, such as quartz, and a volatile fill material emitting light upon breakdown and excitation. A termination fixture represented by the reference numeral 16 has an inner conductor 18 and an outer conductor 20 disposed around the inner conductor 18. The conductors 18 and 20 have first ends 22 and 24, respectively, at which the lamp 14 is disposed and second ends 26 and 28, respectively, which are coupled to the source 12 of microwave power. A transparent dome 23 encloses the second end 24 of the outer conductor. This dome includes a metallic mesh which acts as a shield. Accordingly, the microwave power is absorbed by the lamp 14 to cause breakdown and excitation of the fill material.

According to the invention, a starting control circuit is provided for assisting in the starting of the lamp 14. The source 12 includes a dc power source, which in the embodiment includes an ac source 30, such as a source of power at 60 Hz, and an ac to dc converter 32 for converting the ac power into a dc voltage across output terminals 34 and 36 of the converter 32. The dc power is coupled to a microwave power source 38 via a switch 40. The microwave power source 38 provides an amount of microwave power which is related to the amount of dc power received by the dc power source. The source 38 preferably includes a solid microwave oscillator and a solid state microwave amplifier. Additional details of one suitable power source may be found in the previously mentioned patent application entitled "Solid State Microwave Power Source For Use In An Electrodeless Light Source." The source described in this application includes an oscillator in which a transistor is the active element of a class "C" modified Colpitts type of common base oscillator, a transistorized class C power amplifier and an impedance matching circuit utilizing microstrip elements coupled between the output of the amplifier and the first ends 26 and 28 of the fixture 16 for providing an acceptable impedance transformation from the fixture to the collector of the power transistor and for providing a sufficient amount of power to the lamp during the starting mode. The output of the microwave power source 38 is coupled via a transmission line 42, such as a microstrip, to the inner and outer conductors 18 and 20. A UV light source 44 is disposed near the lamp 14 and is coupled in series between the dc power source 32 and the microwave power source 38 to assist in starting the lamp 14. The UV source upon the emission of light decreases the amount of dc power coupled to the microwave power source to reduce the power output as the lamp is started. In the FIGURE the UV source is shown as being displaced from the lamp 14 only for simplification of illustrating the features of the invention. In actual practice, the UV source is located either within the fixture near the first ends 22 and 24 of the conductors or outside the fixture and adjacent the transparent dome 23. A device represented generally by the reference numeral 46 is responsive to heat from the UV source and provides as shunt path for the dc power to bypass the UV source after the lamp is started. This causes maximum power from the converter 32 to be applied to the microwave power source 38.

A reactive impedance device, such as the capacitor 50, is adapted to be coupled across the conductors 18 and 20 near the second ends 26 and 28 to create a resonant condition in the fixture 16 as microwave power is first applied to the lamp. Given the impedance of the lamp at starting, one skilled in the art may determine the required length measured along the conductor 18 separating the lamp 14 and the capacitor 50 and the required reactive impedance of the capacitor to achieve a condition of resonance. According to the invention, the heat responsive device 46 includes the capability for decoupling the capacitor 50 after the lamp is started.

The heat responsive device 46 includes a switch having a bimetallic element 52 electrically coupled at a first end 55 to a first side 56 of the UV source 44 and a first contact 58 electrically coupled to a second side 60 of the UV source 44. The second end 62 of the bimetallic element 52 moves into contact with the first contact 58 in response to heat to form the shunt path for the dc current through the bimetallic element 52 and around the UV source 44. The capacitive impedance is coupled at one side 64 to the outer conductor 20 and at the other side 66 to the side 55 of the bimetallic element 52. A second contact 68 is electrically coupled to the inner conductor 18. The bimetallic element 52 is positioned such that the second end 62 of the bimetallic element 52 is in contact with the second contact 68 prior to movement of the bimetallic element due to heat. This permits the capacitor 50 to be coupled across the conductors 18 and 20 for starting. In operation, the second end 62 of the element 52 moves away from the second contact 68 in response to heat to decouple the capacitor 50 after the lamp is started. In the embodiment, the bimetallic element 52 has a first strip of conductive material made out of a nickel alloy having a low temperature coefficient and a second strip of conductive material made out of a nickel-chrome steel alloy having a higher temperature coefficient.

In operation, the UV source in series with the microwave power source 38 reduces the voltage on the source 38 so that its power output is less than the full voltage value. This reduced power is fed via the transmission line 42 to the fixture 16. With the combination of the UV and the resonant condition brought about by the starting capacitor, this low power level is sufficient to start the lamp. With the low applied dc voltage, the microwave power source can withstand the mismatches occurring during the lamp warm-up. Some predetermined length of time after the microwave lamp is started, the heat generated by the UV source together with the heat generated in the bimetallic element itself due to absorption of microwave power, cause the bimetallic element 52 to bend downwardly thereby closing the lower contacts. This shunts out the UV source and applies full dc voltage to the source, causing it to produce full power. It can safely do this at this point because the microwave lamp is fully warmed-up and presents a matched load to the source. With the lower contacts closed, the bimetallic element carries the dc current. This heats the bimetallic element, helping to keep the lower contacts closed. Heat from the microwave lamp also tends to heat the bimetallic element. When the on-off switch 40 is open, the bimetallic element relaxes as it cools so that the upper contacts are closed and the system is in the ready-to-start mode. Thus, the major advantages according to the present invention are that there is provided a UV source for the lamp, a build-up of the microwave fields in the termination fixture by way of resonance, impedance matching the fixture to the source in the lamp-off condition and switching of the microwave power source from low power at starting to higher power after breakdown occurs in the lamp. These functions are accomplished automatically since once the on-off switch 40 is turned on, the system operates entirely by itself.

The embodiment of the present invention is intended to be merely exemplary and those skilled in the art shall be able to make numerous variations and modifications of it without departing from the spirit and scope of the present invention. All such variations and modifications are intended to be within the scope of the present invention as defined by the appended claims.

We claim:

1. In an electrodeless light source having a source of power at a microwave frequency, an electrodeless lamp having an envelope made of a light-transmitting material and a volatile fill material emitting light upon breakdown and excitation and a termination fixture having an inner conductor and an outer conductor disposed around the inner conductor, the conductors having first ends associated with the lamp and second ends coupled to the source so that the microwave power terminates at the lamp to cause breakdown and excitation of the fill material, a starting control circuit comprising:

a. the source including a dc power source and a microwave power source receiving the dc power for providing microwave power in an amount related to the amount of dc power received by the dc power source, the output of the microwave power source being coupled to the inner and outer conductors, b. switch means for controlling the application of dc power to the microwave power source, c. a UV light source disposed near the lamp and coupled in series between the dc power source and the microwave power source to emit UV light upon actuation of the switch means to assist in starting the lamp, the UV source upon emission of light decreasing the amount of dc power coupled to the microwave power source to reduce its output as the lamp is started, and d. means responsive to a preselected amount of heat from the UV source for providing a shunt path for the dc power to bypass the UV source and to apply maximum power to the microwave power source.

2. The circuit according to claim 1 further including: capacitive impedance means adapted to be coupled across the conductors at the second end thereof to create a resonant condition in the fixture as microwave power is first applied to the lamp and wherein the heat responsive means further includes means for decoupling the capacitive impedance means after the lamp is started.

3. The circuit according to claim 2 wherein the heat responsive means includes a second switch means having a bimetallic element electrically coupled at a first end to a first side of the UV source and first contact means electrically coupled to a second side of the UV source, a second end of the bimetallic element moving into contact with the first contact means in response to heat to form a shunt path for the dc current through the bimetallic element around the UV source.

4. The circuit according to claim 3 wherein the capacitive impedance means is coupled at one side thereof to the outer conductor and at the other side of the first end of the bimetallic element, the second switch means further having a second contact means electrically coupled to the inner conductor, the bimetallic element being positioned such that the second end of the bimetallic element is in contact with the second contact means prior to movement of the bimetallic element due to heat so that the capacitor impedance means is coupled across the conductors, the second end of the bimetallic element moving away from the second contact means in response to heat to decouple the capacitive impedance means after the lamp is started.

5. The circuit according to claim 4 wherein the bimetallic element includes a first strip of a nickel alloy having a low temperature coefficient and a second strip made of a nickel-chrome steel alloy having a high temperature coefficient.

* * * * *